US011819140B2

(12) United States Patent
Qi et al.

(10) Patent No.: US 11,819,140 B2
(45) Date of Patent: Nov. 21, 2023

(54) MULTIFUNCTIONAL CUP HOLDER AND SOFA

(71) Applicant: HUIZHOU UPSPRING INTELLIGENT TECHNOLOGY CO., LTD., Huizhou (CN)

(72) Inventors: Fayun Qi, Huizhou (CN); Zeming Sun, Huizhou (CN); Zuochao Peng, Huizhou (CN); Dazhuan Tang, Huizhou (CN); Dinglue Chen, Huizhou (CN)

(73) Assignee: Huizhou Upspring Intelligent Technology Co., Ltd., Guangdong (CN)

( * ) Notice: Subject to any disclaimer, the term of this patent is extended or adjusted under 35 U.S.C. 154(b) by 64 days.

(21) Appl. No.: 17/525,849

(22) Filed: Nov. 12, 2021

(65) Prior Publication Data

US 2022/0061537 A1 Mar. 3, 2022

Related U.S. Application Data

(63) Continuation of application No. PCT/CN2019/111375, filed on Oct. 16, 2019.

(30) Foreign Application Priority Data

May 21, 2019 (CN) ..... 201910423591.6

(51) Int. Cl.
*A47C 7/62* (2006.01)
*A47C 7/72* (2006.01)
*A47C 17/86* (2006.01)

(52) U.S. Cl.
CPC ..... *A47C 7/622* (2018.08); *A47C 7/72* (2013.01); *A47C 7/725* (2013.01); *A47C 17/86* (2013.01)

(58) Field of Classification Search
CPC ..... A47C 7/622; A47C 7/72; A47C 7/725; A47C 17/86; A47C 7/624; A47G 19/22
(Continued)

(56) References Cited

U.S. PATENT DOCUMENTS 9,493,102 B2 11/2016 Tang
9,919,632 B2 3/2018 Oh et al.
(Continued)

FOREIGN PATENT DOCUMENTS

CN 201790354 U 4/2011
CN 203137908 U 8/2013
(Continued)

OTHER PUBLICATIONS

International Search Report to PCT Application No. PCT/CN2019/111375 dated Feb. 1, 2020 with English translation,(4p).

*Primary Examiner* — Mark R Wendell
(74) *Attorney, Agent, or Firm* — Arch & Lake LLP

(57) ABSTRACT

The present disclosure provides a multifunctional cup holder for installation on a sofa and a sofa thereof. The cup holder includes: a base configured to attach to a sofa; a cup body; a flange disposed at an upper end of the cup body; and a control assembly disposed on the flange. A lower end of the cup body is attached to the base. The flange is detachable from the upper end of the cup body, and the flange extends radially inward towards a center of the cup body. The control assembly is removable from the flange and is configured to control operations of the multifunctional cup holder or adjustments of the sofa.

20 Claims, 6 Drawing Sheets

(58) Field of Classification Search
USPC ..... 297/188.2
See application file for complete search history.

(56) References Cited

U.S. PATENT DOCUMENTS

| | | | | |
|---|---|---|---|---|
| 10,106,105 | B2 | 10/2018 | Hansen et al. | |
| 2007/0247836 | A1 | 10/2007 | Seidl et al. | |
| 2012/0075842 | A1* | 3/2012 | Goto | B60Q 3/225 220/737 |
| 2012/0217772 | A1 | 8/2012 | Tang | |
| 2015/0175046 | A1 | 6/2015 | Oh et al. | |
| 2016/0046233 | A1 | 2/2016 | Hansen et al. | |
| 2021/0028635 | A1* | 1/2021 | Zhu | B60N 3/104 |

FOREIGN PATENT DOCUMENTS

| | | | |
|---|---|---|---|
| CN | 104723931 | A | 6/2015 |
| CN | 105263752 | A | 1/2016 |
| CN | WO2019084997 | * | 5/2019 |
| CN | 110150933 | A | 8/2019 |

* cited by examiner

MULTIFUNCTIONAL CUP HOLDER AND SOFA

CROSS REFERENCE TO RELATED APPLICATION

The present application is based on and claims priority to a PCT international patent application No. PCT/CN2019/111375, filed on Oct. 16, 2019 which claims priority to the Chinese patent application No. 201910423591.6 filed on May 21, 2019, the entire content of which is incorporated herein by reference for all purposes.

TECHNICAL FIELD

The present disclosure relates to the technical field of cup holders, specifically, to a multifunctional cup holder for installing on a sofa and a sofa thereof.

BACKGROUND

With the general quality of life improved in the modern society, people now seek furniture that brings greater comfort. Some sofas require users to manually push a button or pull a lever on the side to control the mechanical parts of the sofa, if the users need to adjust the positions of the sofa to make it feel more comfortable. Such manual control and operation may be cumbersome and brings inconvenience to some users.

SUMMARY

The present provides a multifunctional cup holder, and a sofa with such cup holder.

The first aspect of the present disclosure provides a multifunctional cup holder for installation on a sofa. The cup holder includes: a base configured to attach to a sofa; a cup body; a flange disposed at an upper end of the cup body; and a control assembly disposed on the flange. A lower end of the cup body is attached to the base. The flange is detachable from the upper end of the cup body, and the flange extends radially inward towards a center of the cup body. The control assembly is removable from the flange and is configured to control operations of the multifunctional cup holder or adjustments of the sofa.

In the second aspect of the present disclosure, a sofa including the multifunctional cup holder is provided. The sofa includes: a sofa body; and a multifunctional cup holder. The multifunctional cup holder includes: a base configured to attach to a sofa; a cup body; a flange disposed at an upper end of the cup body; and a control assembly disposed on the flange. A lower end of the cup body is attached to the base. The flange is detachable from the upper end of the cup body, and the flange extends radially inward towards a center of the cup body. The control assembly is removable from the flange and is configured to control operations of the multifunctional cup holder or adjustments of the sofa.

It is to be understood that both the foregoing general description and the following detailed description are exemplary and explanatory only and are not restrictive of the present disclosure.

BRIEF DESCRIPTION OF THE DRAWINGS

The drawings described here are used to provide a further understanding of the present disclosure and constitute a part of the present disclosure. The examples and descriptions of the present disclosure are used to explain the present disclosure, and do not constitute an improper limitation of the present disclosure.

DETAILED DESCRIPTION

Figure 1:
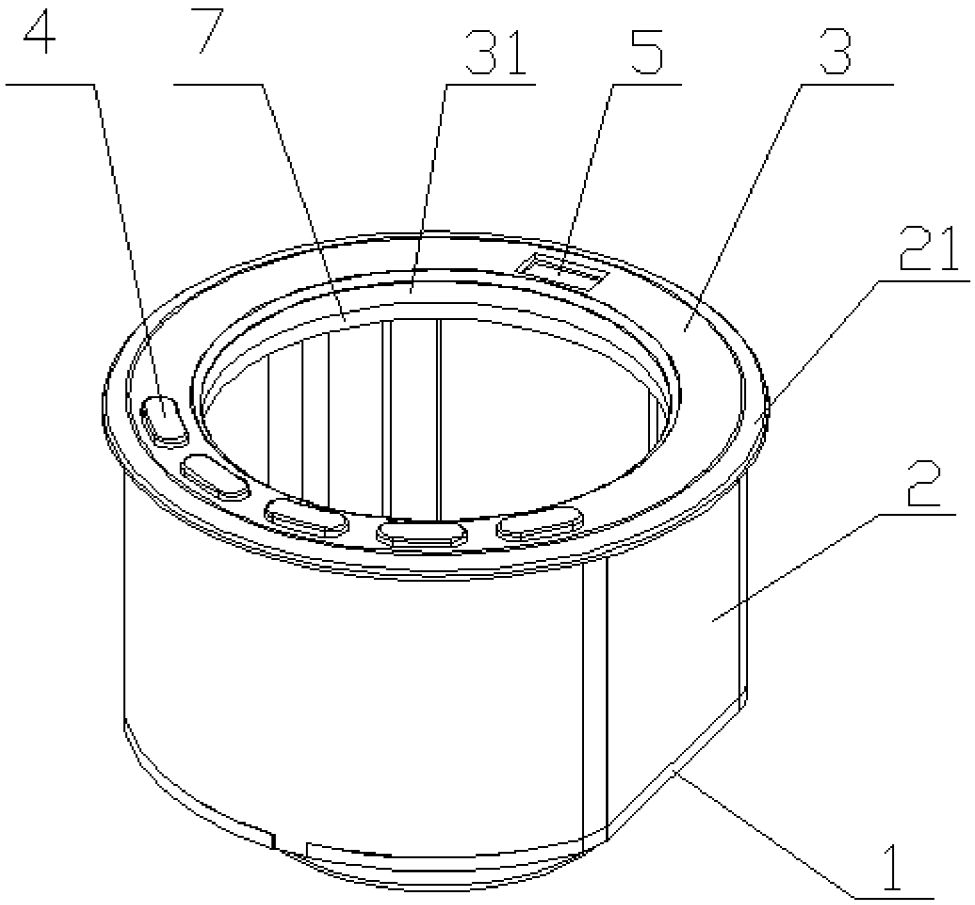
FIG. 1 is a schematic structural diagram in accordance with one or more examples of the present disclosure.

The present disclosure is described with reference to examples and corresponding drawings. The described examples are only part but not all of the examples of the present disclosure. Based on the examples in the present disclosure, all other examples obtained by those ordinary skilled in the art without any inventive work belong to the protection scope of the present disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

The description of numerals used in this disclosure may include: 1. Base; 11. Support Body; 12. Pocket Hole; 13. Diaphragm; 14. Cavity; 2. Cup body; 21. Ring-Shaped Rib; 22. Mounting Seat; 3. Flange; 31. Inward Flange; 32. Button Pocket Hole; 33. USB Pocket Hole; 4. Control Assembly; 41. Circuit Board; 42. Button; 5. USB Port; 6. Channel; 7. Light Guide Plate; 8. Inner Cup.

Example 1

In some examples according to the present disclosure, the cup holder includes a cup body 2 and a base 1. The cup body 2 is approximately tubular. The shape of the cup body 2 may vary to accommodate the needs of the sofa arms where the cup holder would be installed. The cup body 2 may be in a round tubular shape. The cup body 2 may also include straight side walls. In some of the examples, the cross section of the cup body 2 may be a circle with straight sides, such as two or four opposite sides of the cross section are straight lines. Such cup body 2 design with straight side walls has a smaller cross section, compared with a round tubular shape design. Smaller cup bodies may fit in more sofa designs with narrower sofa arms.

The flange 3 is approximately annular and an inward flange 31 extends in the axial direction of the flange's inner circle toward the base 1. The flange 3 and the inward flange 31 may be detachably connected to the cup body 2. The flange 3 may be disposed inside the cup body 2, and the flange 3 may extend radially inward towards the center of the tubular body of the cup body 2. In some examples, a light guide plate 7 is placed below the inward flange 31. The light guide plate 7, which is approximately annular-shaped, has its inner circular side aligned with the inner side of the inner flange 31. The outer wall of the upper end of the cup body 2 is also connected with an annular rib 21, with the annular rib and the upper surface of the flange 3 connected in a smooth manner. The annular rib 21 is a different structure from the flange 3. In some examples, the annular rib 21 is integrated with upper end of the cup body 2, and the annular rib 21 does not include any control button or port. The light guide plate is optional and in some other examples, no light guide plate is provided along the flange.

Figure 2:
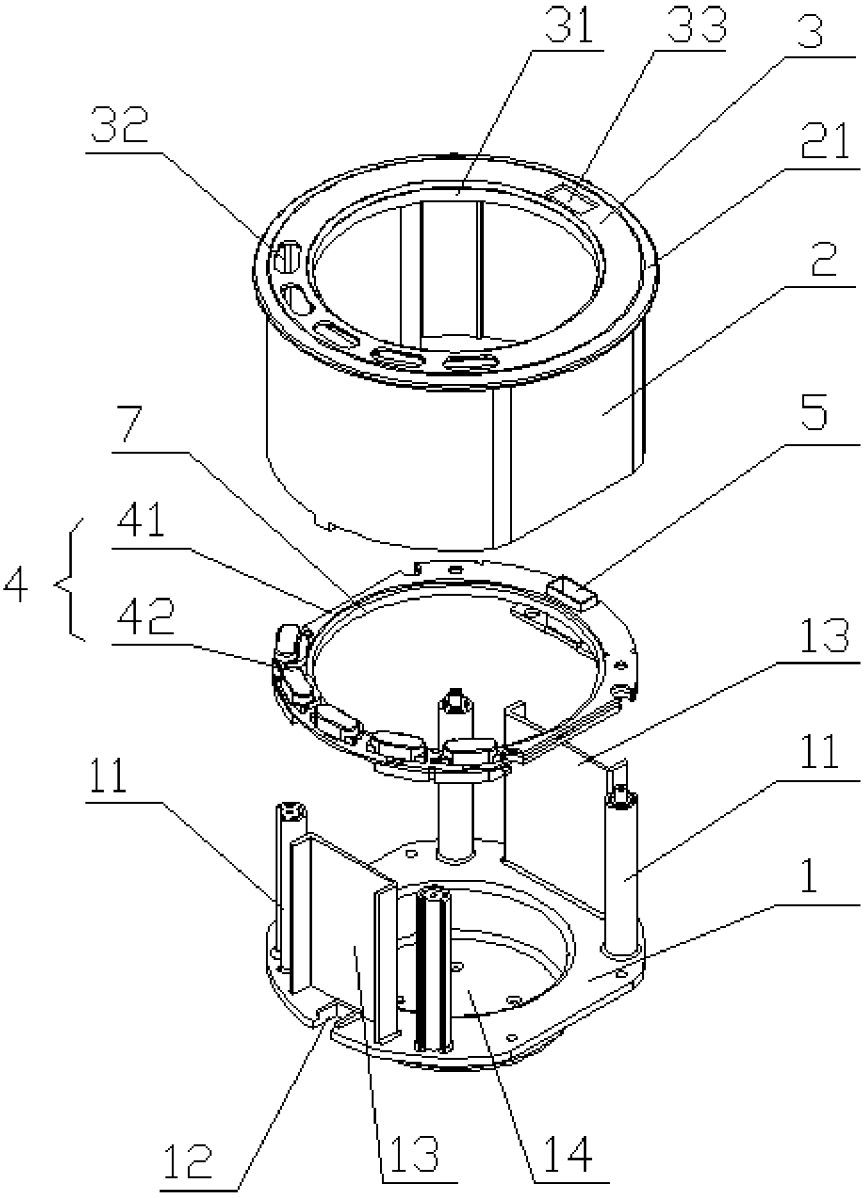
FIG. 2 is an exploded-view drawing of the multifunctional cup holder as shown in FIG. 1.

As illustrated in FIGS. 1 and 2, a control assembly 4 for connection with external equipment is disposed on the flange 3, and a supporting body 11 is placed on the base 1 for fixing the control assembly 4. Specifically, the control assembly 4 includes a circuit board 41 and a button 42 placed on the circuit board. In some examples, the circuit board 41 is placed on the upper surface of the light guide plate 7, and the circuit board and the light guide plate are fixed on the supporting body 11. The button 42 protrudes from the button pocket hole 32 on the flange 3, thereby protecting the control assembly 4 from damages and dust. The control assembly may include one or more control buttons, and the control assembly 4 may be programmable to switch between different control modes. In some examples, when the cup holder is installed on an adjustable sofa unit, the control assembly 4 may programmed to control the conversion between different sofa positions. The control buttons may be wired to connect with the reclining mechanism of the sofa, and may control the sofa to convert between a sitting position and various reclining positions. In some other examples, the control assembly 4 may also be programmed to control the operations of the lighting provided in some examples of the cup holder, and such control assembly 4 can also be disconnected from controlling the lights pursuant to the needs of users. One of the control buttons may be wired to the control the state (on/off) of the light source that is connected to the cup holder. The light source may be disposed inside the cup holder, or the light source may also be external and electrically connected to the cup holder. The control buttons may be disconnected from the light source through a pre-programmed circuit or changed wirings, and the control buttons that are connected with the light sources may be switched to control the conversions of the sofa based on the user's needs.

In some examples, a USB port 5 is further placed on the flange 3. The USB port 5 is fixed on the support body 11, and the flange 3 has a USB pocket hole 33, thus, Mobile phones, computers, etc. can be charged through the USB port. In some other examples, the flange 3 may also have an audio port for connecting to an external audio device, and the USB port 5 and the audio port can be placed separately or together. Multiple USB ports and audio ports may also be provided based on the needs of users.

Figure 3:
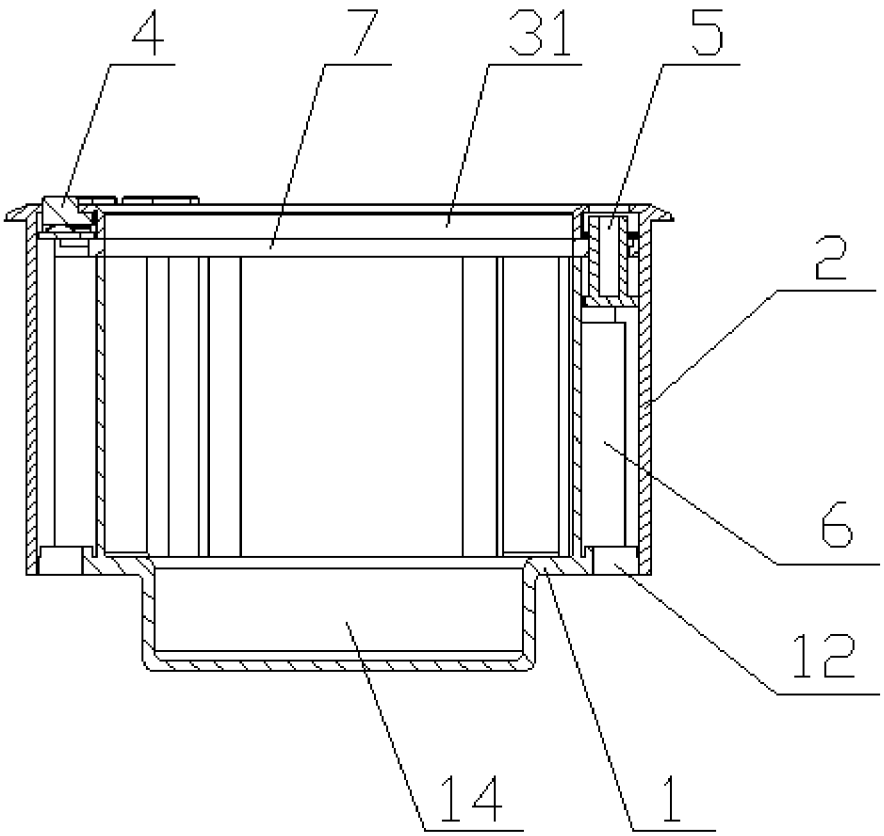
FIG. 3 is a cross-sectional view of the multifunctional cup holder as shown in FIG. 1.

As shown in FIGS. 2 and 3, in an example, a pocket hole 12 and a diaphragm 13 are placed symmetrically on the base 1. A pair of pocket holes are disposed at the opposite curved side of the base 11, and two diaphragms are separately placed next to the two pocket holes. The diaphragm 13 is approximately U-shaped and vertically placed on the surface of the base 1. The upper end of the diaphragm 13 abuts the light guide plate 7. The diaphragm 13 and the inner wall of the cup 2 form a channel 6 for running wires, and the pocket hole 12 is located on the surface of the channel. Therefore, the wires connecting the external devices are hidden in the channel 6 for protection.

In this example, the base 1 is recessed with a cavity 14 in the direction away from the cup body 2. The cavity 14 is circular and its diameter is smaller than the inner diameter of the inward flange 31, so that the cavity can be used to hold a cup with a smaller cup diameter.

Example 2

Figure 4:
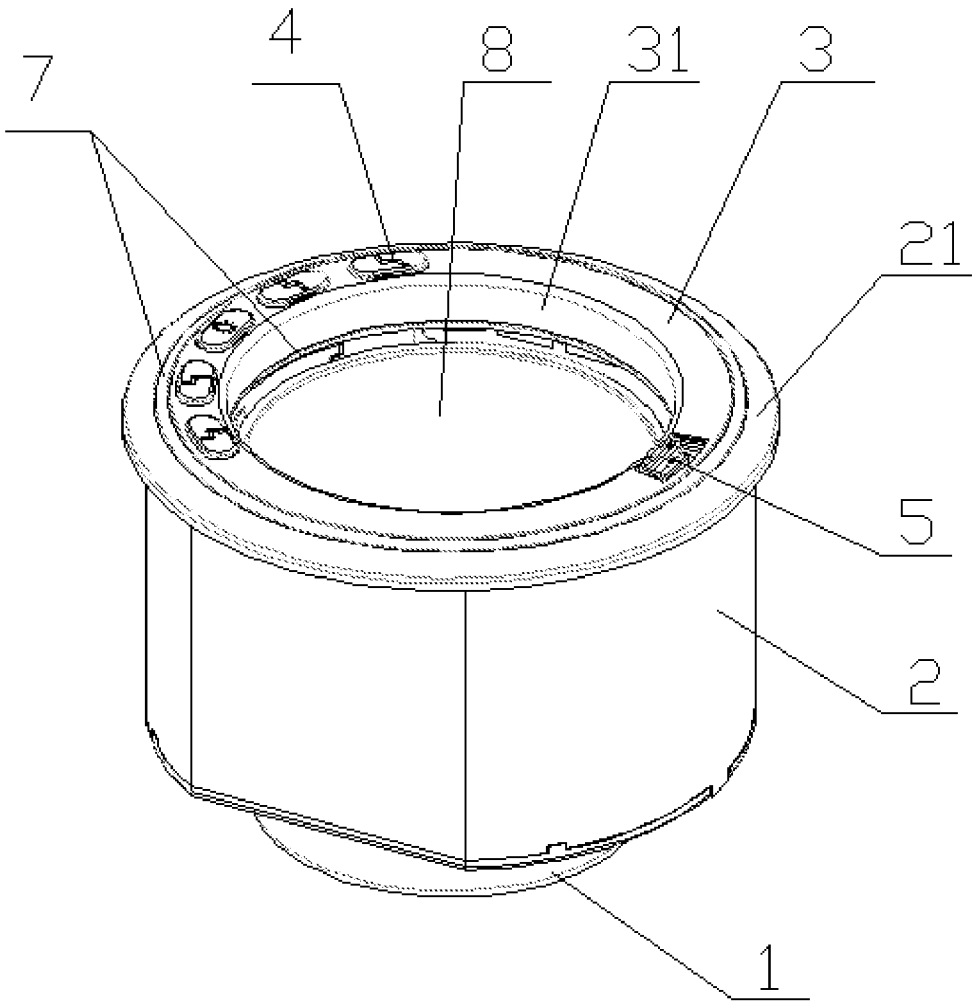
FIG. 4 is a schematic structural diagram in accordance with one or more examples of the present disclosure.
Figure 5:
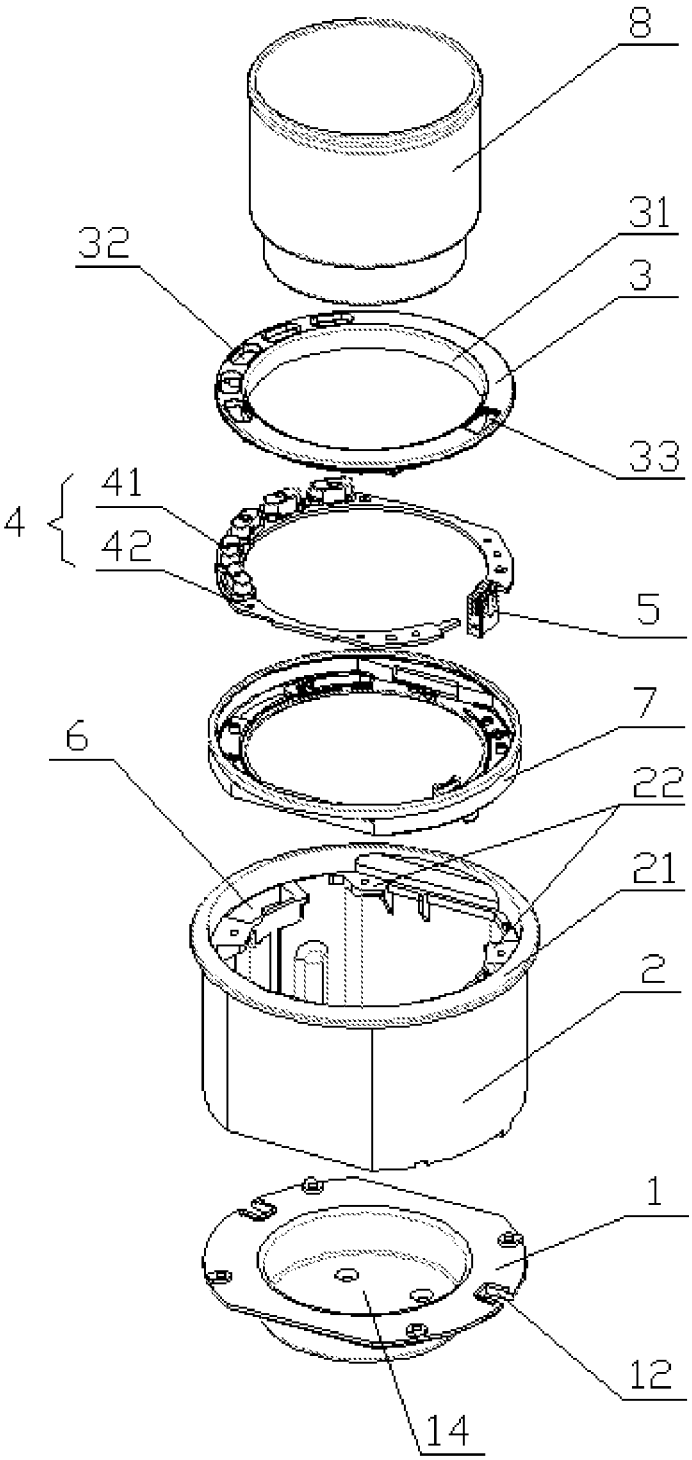
FIG. 5 is an exploded view drawing of the multifunctional cup holder as shown in FIG. 4.
Figure 6:
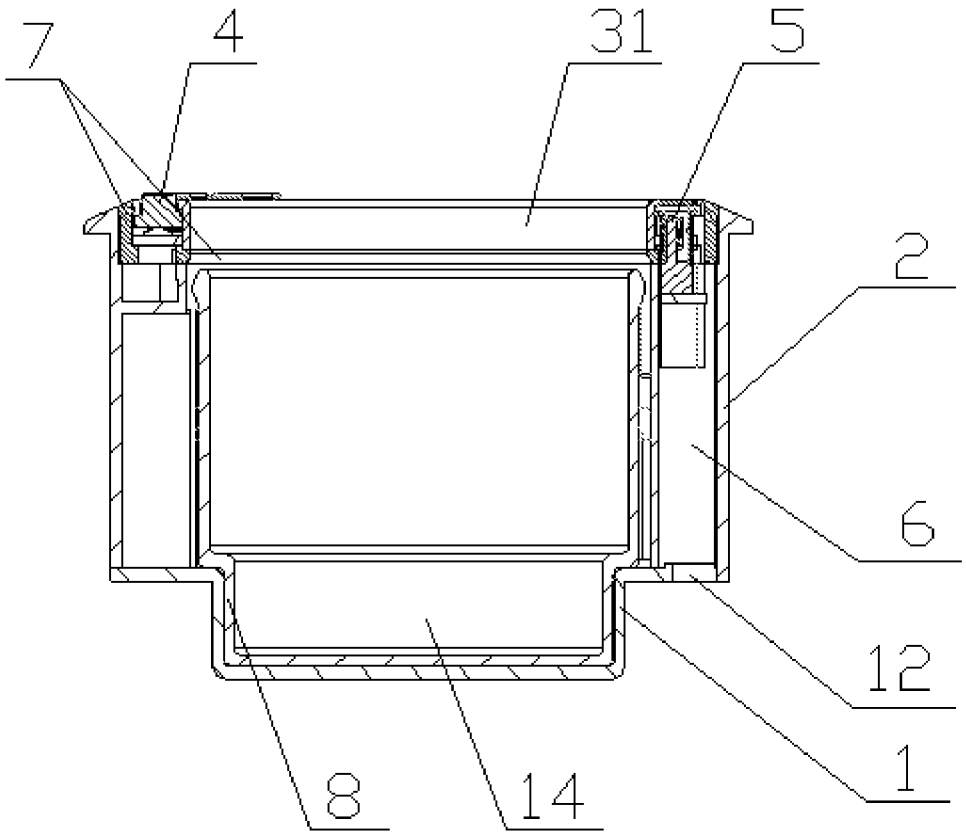
FIG. 6 is a cross-sectional view of the multifunctional cup holder as shown in FIG. 4.

According to FIGS. 4 to 6, the cup holder includes a base 1, a cup body 2, a flange 3, and a control assembly 4. In some examples, the base 1 is configured to connect to a sofa, and the lower end of the cup body 2 is connected to the base. The flange 3 is placed on the upper end of the cup body 2, and the control assembly 4 is arranged on the flange, which is configured to connect to external equipment. Thus, the base 1 and the cup body 2 constitute an accommodating cavity, which can be used to place cups and other beverage-containing items. With the control assembly 4 connected to the external equipment mounted on the flange 3, the control assembly can be used to adjust the position of the sofa to a comfortable state according to personal needs, which is convenient and flexible to use. In some examples, the flange 3 may be detached from the cup body 2 by users, and it is easier for the users to clean the cup holder. Meanwhile, the base 1 and the cup body 2 are designed as two separate bodies, which eases the installation and removal of the cup holder on the sofa.

In some examples, the cup body 2 is approximately tubular, and the flange 3 is placed inside the upper end of the cup body. The flange is approximately annular, and its inner circle faces the base. An inward flange 31 extends in the direction toward the base 1. Optionally, the light guide plate 7 is placed at the upper end of the cup body 2. Specifically, the light guide plate 7 is located between the cup body 2 and the flange 3, and the light guide plate is approximately cylindrical. The upper surface of the light guide plate 7 is at the same level with the upper surface of the flange 3, and the lower surface of the light guide plate is bent radially inward with an inner transverse edge (not shown in the figure), and the inner side of the inner transverse edge is aligned with the inward flange 31.

The inward flange 31, the flange 3, and the cup body 2 form a mounting cavity for accommodating the control assembly 4, wherein the cavity protects the control assembly from damages, dust and water. A slice of the inner surface of the light guide plate 7 is exposed under the flange 31, which emits light with the assistance of an external light source, so that people can find the position of the cup holder in a dark environment. The light guide plate 7 can also be made of fluorescent material. The present disclosure does not intend to limit the materials which the light guide plate 7 can be made of. In some other examples, no light guide plate is provided inside the cup body.

In some examples, a ring-shaped rib 21 is also placed on the outer wall of the upper end of the cup body 2, and the ring-shaped rib 21 is at the same level with the upper surface of the flange 3. Therefore, when the cup holder is installed on the sofa, the lower surface of the ring-shaped rib 21 abuts the armrest surface of the sofa, and the ring-shaped rib blocks the gap between the cup body 2 and the mounting hole on the armrest, which can stabilize the cup holder and serve decorative purposes.

In the example shown in FIGS. 4 and 5, a control assembly 4 is placed on the flange 3 for connection with external equipment, and a mounting seat 22 is placed on the cup body 2 for fixing the control assembly, the light guide plate 7 and the flange 3. Specifically, the control assembly 4 includes a circuit board 41 and a button 42 electrically connected to the circuit board. The circuit board 41 is located on the light guide plate 7, and the button 42 protrudes from the button pocket hole 32 on the flange 3. The design may protect the control assembly 4 from damages and dust.

In this example, the flange 3 further includes a USB port 5, which is fixed on the support body 11. The flange 3 also has a USB pocket hole 33, so that users can charge mobile phones, computers, etc. through the USB port 5. In other examples, the flange 3 may also have with an audio port for connecting to an external audio device, and the USB port 5 and the audio port can be placed separately or together.

As illustrated in FIGS. 5 and 6, in this example, a channel 6 for running wires is placed on the inner side wall of the cup body 2, so that the wires connected to external devices can be hidden in the channel and thus protected.

In this example, the base 1 is recessed with a cavity 14 in the direction away from the cup body 2. The cavity 14 is circular and its diameter is smaller than the inner diameter of the inner flange 31, so that a cup with a smaller cup diameter can be placed in the cavity.

The cup holder also includes an inner cup 8, and the inner cup is detachably installed in the cup body 2. The inner cup 8 is placed inside the cup body 2, and is designed to hold cups and cans of various sizes. Specifically, the inner cup 8 is approximately cylindrical, and its outer diameter is smaller than the inner diameter of the inner flange 31, so that the inner cup can be installed in the cup body 2 with a clearance fit. As a result, canned drinks and the like can be placed on the inner cup 8 for the ease of cleaning and moisture resistance. The inner cup 8 can also be used as an ashtray. At the same time, the inner cup 8 can be replaced at any time to match the sofa for decorative purposes. In some examples, the inner cup 8 is integrated with the cup body 2 as one piece; while in some other examples, the inner cup 8 can be easily removed from the cup body 2 and the cup holder. The removable inner cup 8 may allow users to clean the cup holder more easily, and the users may replace the inner cup itself without uninstall the whole cup holder.

The present disclosure also provides a sofa that includes the multifunctional cup holder. The sofa may include a sofa body with various seating structures, and a multifunctional cup holder as disclosure in the above examples installed on the sofa arms.

The multifunctional cup holder in the present disclosure, by setting the flange 3 and the control assembly 4 on the cup holder, may not only allow users to put canned drinks on the cup holder, but also enable users to adjust the position of the sofa to a comfortable state according to personal needs. The design may also allow for convenience and flexibility. At the same time, the base 1 and the cup body 2 are built as separate bodies to facilitate the stable installation and removal of the cup holder on the sofa. Through the USB port 5 and the audio port, mobile phones, computers, etc. can be charged, and a user can connect audio devices to the sofa. Channel 6 can be used to hide and protect the wires connected to external devices. The light guide plate 7 can emit light with the assistance of external light sources, so that users can find the cup holder in a dark environment. By placing the inner cup 8 inside the cup body 2, canned drinks can be placed on the inner cup for the ease of cleaning and moisture resistance. The inner cup 8 can also be used as an ashtray. Meanwhile, the inner cup 8 can be replaced at any time to match the sofa for decorative purposes.

By placing the flange and the control assembly on the cup holder, the present disclosure not only provides a cup holder that allows a user to put canned drinks in, but also enables a user to adjust the position of the sofa to a comfortable state according to personal needs, which is convenient and flexible to use. Meanwhile, the base and the cup holder are designed as two separate bodies, which eases the installation and removal of the cup holder on the sofa.

Some examples of the present disclosure provide a multifunctional cup holder for installation on a sofa. The cup holder includes: a base configured to attach to a sofa; a cup body; a flange disposed at an upper end of the cup body; and a control assembly disposed on the flange.

Further, the flange is placed inside the cup body.

Since the flange is placed on the inside of the upper end of the cup body, the design may facilitate the installation of the control assembly and the wires connected to the external equipment.

Further, the upper end of the cup body extends radially inward to form the flange.

As a result, the cup body and the flange are integrated, which saves production costs and strengthens the overall structure.

Further, the flange has an annular shape, and an inward flange extends in the axial direction of the flange's inner circle toward the base.

As a result, the circuit board of the control assembly can be installed between the inward flange and the flange as well as the cup body, so that the inward flange, the flange, and the cup body can protect the circuit board from dust and water.

Further, a USB port and/or audio port are also placed on the flange.

As a result, it is possible to charge mobile phones, computers, etc., and connect external audio devices to the sofa through USB ports and audio ports.

Further, a channel for running wires is placed on the side wall of the cup body.

As a result, the wires connected to the external equipment are hidden in the channel, which plays a role of hiding and protecting the wires connected to the external equipment.

Further, a ring-shaped rib is located on the outer wall of the upper end of the cup body.

As a result, the ring-shaped rib plays a role of stabilizing the cup holder and decoration.

Further, the presently disclosed technology also includes a light guide plate which is place at the upper end of the cup body.

Therefore, the light guide plate can emit light with the assistance of an external light source, so that users can find the cup holder in a dark environment.

Further, it also includes an inner cup, and the inner cup is detachably installed inside the cup body.

As a result, canned drinks and the like can be placed on the inner cup for the ease of cleaning and moisture resistance. The inner cup can also be used as an ashtray. At the same time, the inner cup can be replaced at any time to match the sofa for decorative purposes.

A sofa includes the multifunctional cup holder.

In summary, the multifunctional cup holder provided by the present disclosure may possess the following effects:

1) By installing the flange and the control assembly on the cup holder, a user can not only put cans of drinks on the cup holder, but also adjust the position of the sofa to a comfortable state according to personal needs, which offers convenience and flexibility. Meanwhile, the base and the cup holder are designed as two separate bodies, which eases the installation and removal of the cup holder on the sofa.
2) A user can charge mobile phones, computers, etc., and connect audio devices to the sofa through USB ports and audio ports.
3) With a channel on the side wall of the cup body that is used to run wires, wires connected to external equipment can be hidden and protected.
4) The light guide plate can be used as an external light source to emit light, so that people can find the cup holder in a dark environment.
5) With the inner cup installed inside the cup body, the canned drink can be placed on the inner cup for ease of cleaning and moisture resistance. The inner cup can also be used as an ashtray. At the same time, the inner cup can be replaced at any time to match the sofa for decorative purposes.

The present disclosure may include dedicated hardware implementations such as application specific integrated circuits and other hardware devices. The hardware implementations can be constructed to implement one or more of the methods described herein. Examples that may include the apparatus and systems of various implementations can broadly include a variety of mechanical systems. One or more examples described herein may implement functions using two or more specific interconnected hardware devices or units with related control and data signals that can be communicated between and through the units, or as portions of the device. Accordingly, the apparatus or system disclosed may encompass software and hardware implementations. The terms "circuit," "sub-circuit," "unit," or "sub-unit" may include memory (shared, dedicated, or group) that stores code or instructions that can be executed. The unit or circuit may include one or more components that are connected.

The above examples of the present disclosure focus on the differences among various examples, and the different optimization features among the various examples can be combined to form a better example as long as they are not contradictory, which will not be detailed here for brevity concern.

The above-described are only examples of the present disclosure, and are not used to limit the present disclosure. For those skilled in the art, various modifications and variations are possible. Any modification, equivalent substitution, improvement, and others made within the spirit and principle of the present disclosure shall be included within the scope the present disclosure.

The invention claimed is:

1. A multifunctional cup holder for installation on a sofa, comprising:
a base configured to attach to a sofa;
a cup body, wherein a lower end of the cup body is attached to the base;
a flange disposed at an upper end of the cup body, wherein the flange is detachable from the upper end of the cup body, and the flange extends radially inward towards a center of the cup body;
a control assembly disposed on the flange, wherein the control assembly is removable from the flange and is configured to control operations of the multifunctional cup holder or adjustments of the sofa; and
a supporting body placed on the base for fixing the control assembly,
wherein the control assembly comprise a circuit board and a button placed on the circuit board, the circuit board is placed on an upper surface of a light guide plate, and the circuit board and the light guide plate are fixed on the supporting body.

2. The multifunctional cup holder of claim 1, wherein the flange is disposed inside the cup body.

3. The multifunctional cup holder of claim 2, wherein the flange is in a substantially annular shape, and the flange further comprises an inward flange, wherein the inward flange extends in an axial direction of the flange's inner circle towards the base.

4. The multifunctional cup holder of claim 1, wherein a USB port or an audio port is disposed on the flange.

5. The multifunctional cup holder of claim 1, wherein a channel for running wires is disposed on a side wall of the cup body.

6. The multifunctional cup holder of claim 1, wherein a ring-shaped rib is disposed on an outer wall of the upper end of the cup body.

7. The multifunctional cup holder of claim 1, further comprising:
the light guide plate disposed at the upper end of the cup body.

8. The multifunctional cup holder of claim 1, further comprising:
an inner cup detachably mounted inside the cup body.

9. The multifunctional cup holder of claim 7, wherein the control assembly is programmable and is connected to control operations of a light source through the light guide plate, and the button of the control assembly is configured to switch between controlling the operations of the light source and controlling reclining positions of the sofa.

10. The multifunctional cup holder of claim 1, wherein the control assembly is programmable and is connected to control conversions of the sofa between different reclining positions.

11. A sofa, comprising:
a sofa body; and
a multifunctional cup holder comprising:
a base configured to attached to a sofa;
a cup body, wherein a lower end of the cup body is attached to the base;
a flange disposed at an upper end of the cup body, wherein the flange is detachable from the upper end of the cup body, and the flange extends radially inward towards a center of the cup body;
a control assembly disposed on the flange, wherein the control assembly is removable from the flange and is configured to control operations of the cup holder or adjustments of the sofa; and
a supporting body placed on the base for fixing the control assembly,
wherein the control assembly comprise a circuit board and a button placed on the circuit board, the circuit board is placed on an upper surface of a light guide plate, and the circuit board and the light guide plate are fixed on the supporting body.

12. The sofa of claim 11, wherein the flange is disposed inside the cup body.

13. The sofa of claim 12, wherein the flange is in a substantially annular shape, and the flange further comprises an inward flange, wherein the inward flange extends in an axial direction of the flange's inner circle towards the base.

14. The sofa of claim 11, wherein a USB port or an audio port is disposed on the flange.

15. The sofa of claim 11, wherein a channel for running wires is disposed on a side wall of the cup body.

16. The sofa of claim 11, wherein a ring-shaped rib is disposed on an outer wall of the upper end of the cup body.

17. The sofa of claim 11, wherein the light guide plate is disposed at the upper end of the cup body.

18. The sofa of claim 11, wherein the multifunctional cup holder further comprises an inner cup detachably mounted inside the cup body.

19. The sofa of claim 17, wherein the control assembly is programmable and is connected to control operations of a light source through the light guide plate, and the button of the control assembly is configured to switch between controlling the operations of the light source and controlling reclining positions of the sofa.

20. The sofa of claim 11, wherein the control assembly is programmable and is connected to control conversions of the sofa between different reclining positions.

* * * * *